United States Patent [19]

Austen

[11] 4,028,919

[45] June 14, 1977

[54] METHOD FOR EXTRUSION

[76] Inventor: Alfred R. Austen, 744 Georgia Ave., Reading, Pa. 19605

[22] Filed: Aug. 9, 1972

[21] Appl. No.: 712,673

Related U.S. Application Data

[63] Continuation-in-part of Ser. No. 642,907, Dec. 22, 1975, Pat. No. 3,999,415.

[52] U.S. Cl. ..... 72/56; 72/253 R; 72/261; 72/377; 72/468

[51] Int. Cl.[2] ..... B21D 26/02; B21C 3/06

[58] Field of Search ..... 72/253, 261, 377, 468, 72/56

[56] References Cited

UNITED STATES PATENTS

| | | | |
|---|---|---|---|
| 723,873 | 3/1903 | Howe | 72/468 |
| 1,922,770 | 8/1933 | Kornbrath | 72/468 |
| 3,392,562 | 7/1968 | Fuchs, Jr. | 72/DIG. 31 |
| 3,415,088 | 12/1962 | Alexander et al. | 72/56 |

*Primary Examiner*—Leon Gilden
*Attorney, Agent, or Firm*—James C. Simmons

[57] ABSTRACT

Die arrangement for use with conventional and hydrostatic extrusion presses consisting of a first die for providing a first extruded section of a billet and a second die cooperating with the first die to further extrude said first extruded section to final shape. Successive dies beyond the second die are contemplated to provide successive step-wise extrusion for greater reductions, especially of large billets. The method of the invention comprises step-wise incremental sequential extrusion of the billet and extruded portions of the billet until the final shape is achieved.

13 Claims, 14 Drawing Figures

METHOD FOR EXTRUSION

CROSS-REFERENCE TO RELATED APPLICATION

This application is a continuation-in-part of my U.S. Patent application Ser. No. 642,907 filed Dec. 22, 1975, now patent 3,999,415.

BACKGROUND OF THE INVENTION

1. Field of the Invention

The present invention relates to the field of extrusion and, in particular, to those extrusion processes wherein the object being extruded, e.g. a billet of metal or other extrudable material, is forced through a die by mechanical or hydrostatic means. In particular, the invention pertains to those extrusion processes where successive extrusions are accomplished on the original billet in a step-wise fashion. More particularly, the invention pertains to multiple die arrangements in order to provide greater extrusion reductions on a given extrusion press or apparatus wherein a solid or hollow billet undergoes multiple reductions without increasing the extrusion pressure.

2. Description of the Prior Art

Extrusion processes have been used for many years for producing semi-finished shapes in metals such as bars, wire, tubing, and complicated finished shapes such as H's, angles, and the like. Conventional extrusion processes are employed for both hot and cold extrusion, e.g. where the billet undergoing extrusion is either raised to an elevated temperature or is extruded at ambient, the former being more common for metals and the latter for plastics. The use of an elevated temperature will generally depend upon the material being extruded, the size of the initial billet, and the size and shape being extruded. Both hot and cold processes also encompass the use of lubricants and other aids to minimize the friction between the die and the material being extruded. Conventional extrusion processes are illustrated in U.S. Pat. Nos. 2,123,416 and 2,135,193. Extrusion dies used in such processes, and in particular in a multiple die set are illustrated in U.S. Pat. No. 3,553,996.

More recently, the hydrostatic extrusion technique has become widely adopted for use in extruding materials heretofore difficult to extrude by techniques illustrated by the above patents or materials that, because of their propensity to oxidize at elevated temperature or materials that require closer dimensional control, are better suited to cold extrusion. Generally, cold extrusion of such materials by conventional techniques requires equipment capable of very high extrusion pressures. In the hydrostatic technique, a fluid raised to an elevated pressure forces the billet through the die to achieve the final shape. An excellent discussion of the history of hydrostatic extrusion is contained in the specification of U.S. Pat. No. 3,491,565. Hydrostatic extrusion processes are illustrated in U.s. Pat. Nos. 3,126,096; 3,343,388; 3,677,049; and 3,893,320. One type of hydrostatic extrusion die is illustrated in U.S. Pat. No. 3,583,204.

In addition, materials can be and have been formed into elongated shapes by drawing through a die. Such processes are illustrated in U.S. Pat. No. 3,740,990.

It is well known in the art that the maximum allowable reduction for a billet undergoing an extrusion process is limited by the extrusion pressure applied to the billet as it enters the extrusion die, the billet material flow stress, and the die friction. In both hot and cold extrusion, whether conventional or hydrostatic, the limits of allowable stresses in the components of the extrusion apparatus (extrusion chamber, ram, and dies) restrict the maximum extrusion pressure that can be produced with a given apparatus. Thus, regardless of the design of the extrusion apparatus, the maximum extrusion pressure and resultant reductions accomplished by that pressure are limited by the materials of construction of the apparatus.

The reduction limit means that, for many extruded products, the initial billet must be limited in cross-sectional area, otherwise the reduction will have to be accomplished in successive steps. This size limitation is most severe in conventional and hydrostatic extrusion processes that are carried out at ambient temperature (so-called cold extrusion processes) because of the high flow stress and work hardening of the material being extruded. The advantage of large extrusion reductions, associated with hot extrusions, must be sacrificed if the improvements in tolerances and properties resulting from cold extrusion are desired or necessary. As pointed out above, cold extrusion may be the only process available if the material is one that oxidizes readily, or suffers some other form of degradation, at elevated temperature.

It is well known that hydrostatic extrusion processes are advantageous in that: (1) high pressures can be applied to the billet for greater reduction ratios; (2) there is generally a small die cone angle; (3) the extruded product can be made to close dimensional tolerances; (4) conditions of good lubrication exist; and (5) there is less die wear. However, hydrostatic extrusion may not be available for use with some products because the extruded product volume (primarily determined by the long length required) necssitates an initial billet, which is too large in diameter to be extruded in one step. When hydrostatically extruding certain materials, it becomes necessary to extrude the material into a pressurized container to increase the hydrostatic stress state during the forming operation. This process requires a pressurized container of sufficient size to accept the entire extrusion product which limits the pressure differential across the extrusion die, thus further restricting the reduction ratio between the initial billet and the extrusion product.

One problem often associated with hydrostatic extrusion is the unstable, so-called stick-slip extrusion action, which is usually minimized or eliminated by some form of mechanical action such as pushing on the billet or pulling on the extrusion. This unstable extrusion action is essentially an unsolved problem when large reductions are attempted on cold or elevated temperature (below crystalline melting temperature) polymeric materials using the hydrostatic extrusion process.

SUMMARY OF THE INVENTION

The present invention pertains to a die assembly for use with conventional and hydrostatic extrusion presses wherein the die assembly consists of a first die which yields as a product a first extruded portion of a billet forced through the first die. A second die in the assembly cooperates with the first die to extrude the first extruded portion of the billet to final dimensions. With an assembly according to the present invention, it is possible to take successive reductions by adding additional dies and the means to operate these dies, thus avoiding all extrusion reduction limitations normally associated with conventional and hydrostatic extrusion processes.

The method of the present invention comprises incremental sequential extrusion of the original billet until the final size and shape are achieved. The method does not continuously extrude the billet in the usual sense, rather portions of the billet are extruded sequentially to achieve the final product. Using the method of the present invention helps to minimize and, in a large number of cases, eliminate the stick-slip associated with prior art hydrostatic extrusion processes.

Therefore, it is the primary object of the present invention to provide an improve extrusion process.

It is another object of the present invention to provide an improved die assembly and means for operating the dies for use with conventional and hydrostatic extrusion presses.

It is still another object of the present invention to provide an improved method and apparatus for extrusion which can overcome reduction limitations of conventional apparatus by taking multiple reductions on a billet as it exits from an extrusion chamber with a multiple die arrangement.

It is yet another object of the present invention to provide an extrusion process that can be a combination hydrostatic and conventional die method.

DETAILED DESCRIPTION OF THE PREFERRED EMBODIMENT

Figure 1A:
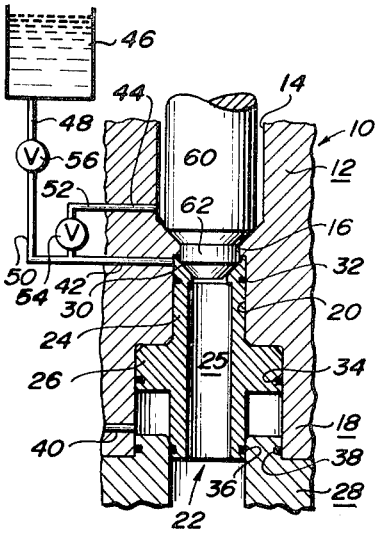
FIGS. 1*a*, *b*, and 1*c* are fragmentary sectional views illustrating both the method and apparatus of the present invention.
Figure 1B:
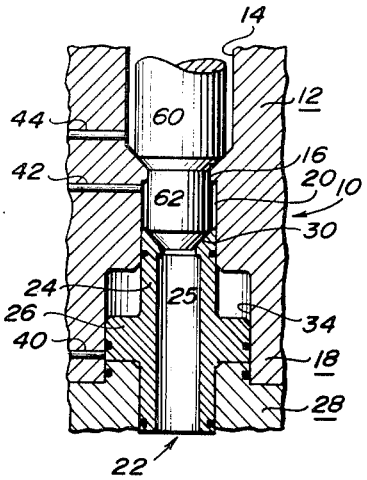
Figure 1C:
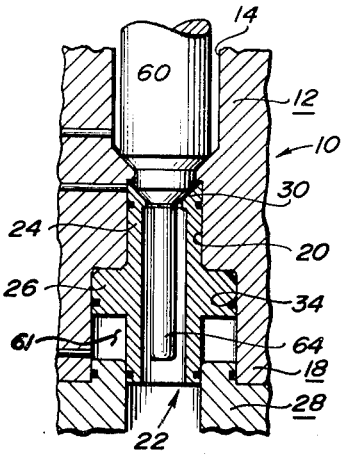

Referring now to the drawing, and in particular to FIGS. 1*a*, 1*b*, and 1*c*, there is shown a cylinder 10 having a first section 12 defining a first, or billet chamber 14. Billet chamber 14 terminates in a die opening 16. Below the die opening 16 is a second section 18 of cylinder 10 defining a receiving or first extrusion product chamber 20 for receiving the extrusion product. Slidably mounted within the opening 20 is a second die or die assembly shown generally as 22 having a die section 24 and a piston section 26. The bottom of cylinder 10 is closed by a suitable plug 28 which defines the one limit of the stroke or path of travel permitted for second die 22. Of course, the upper limit of travel of the die 22 is determined by the bottom or outlet of die opening 16. In referring to a die in the present specification, Applicant means that structure having an inlet opening, a smaller outlet opening, and a deformation zone therebetween as is well known in the art. The present specification is structured so that the dies are vertically oriented with each successive stage below the previous one. The secondary die 22 has a central bore 25 communicating with die opening 30. Die opening 30 is placed so that it is immediately adjacent to die opening 16 and in axial alignment therewith.

Conventional sealing members such as O-rings 32, 34, 36, and 38 are provided in suitable grooves or recesses on the secondary die 22 and end closure 28 respectively. Cylinder 10 includes conduits or ports 40, 42, and 44 respectively, the function of which will be explained in detail hereinafter. For illustrative purposes, a reservoir 46, conduits 48, 50, 52 and check valve 56 and valve 54 are shown associated with conduits 42 and 44. With the apparatus illustrated in FIGS. 1*a*, 1*b*, and 1*c*, it is possible to accomplish extrusions in the following manner. Chamber 14 of cylinder 10 defines a high pressure chamber which can be of extended length and closed at a location remote from die opening 16 by a stationary closure (not shown) or moveable ram (not shown) to provide the driving force for the primary extrusion as is well known in the art. Chamber 14 is designed to withstand high operating fluid pressure so that the original billet 60 can be extruded to a reduced section 62 which section size is defined by the die opening 16. The fluid maintained in chamber 14 is pressurized by a ram or external pump as is well known in the art to cause the primary extrusion to proceed at a preselected rate. During this portion of the extrusion cycle, valve 54 is closed, thus maintaining the fluid pressure in chamber 14. As the original billet 60 is extruded through the primary die opening 16, the first or primary extrusion product 62 pushes on secondary die 22 causing it to move in a longitudinal direction. As shown in FIG. 1*b*, the action of billet section 62 causes the die 22 and piston section 26 to cause a fluid (normally disposed in the annulus defined by piston 26, end closure 28, and the bottom portion of die 22 as illustrated in FIG. 1*a*, when die 22 is in contact with die opening 16) to be forced through conduit 40 to a reservoir (not shown). Simultaneously, fluid is withdrawn from reservoir 46 through a check valve 56 and conduit 50 through conduit 42 into the cavity defined by primary extrusion 62 and wall 20 of cylinder 10 when the die 22 is in the lowermost position as illustrated in FIG. 1*b*.

When die 22 completes its stroke by having piston section 26 contact end closure 28, the initial cycle of the primary extrusion stops. At this point, valve 54 is opened so that the cavity defined by wall section 20, first extrusion 62 and the top of die 22 is pressurized with fluid from chamber 14. At this point, fluid is forced through conduit 40, thus causing die 22 to move upwardly against primary extrusion product 62, causing it to flow through die opening 30, thus becoming a seconary extrusion product 64 (FIG. 1*c*). As secondary die 22 performs the extrusion process on primary extrusion 62, fluid is forced out through conduit 42 through valve 54 through conduits 52 and 44 into cylinder 14, thus maintaining pressure equilibrium in the fluid contained in the chamber 14. The secondary extrusion continues until die 22 has traveled its full stroke as shown in FIG. 1*c*. At this point, valve 54 is closed and the hydraulic fluid below piston section 26 is depressurized by flowing through conduit 40 into an external reservoir (not shown) and the extrusion through die opening 16 of the billet 60 resumes under the action of the fluid contained in chamber 14. This action initiates another extrusion cycle which continues in accordance with the cycle described hereinabove. Successive extrusion cycles are repeated until the desired amount of original billet 60 is extruded to the final size and shape 64. The process can encompass either complete or partial extrusion of the original billet 60 as desired.

The unstable stick-slip extrusion action, often associated with hydrostatic extrusion, can be controlled by the apparatus as illustrated in FIGS. 1*a*, 1*b*, and 1*c* for the primary extrusion through die opening 16 by controlling the rate at which hydraulic fluid leaves the annulus or secondary pressure chamber 61, defined by piston section 26, closure 28 and the wall of second section 18 of cylinder 10 (FIG. 10*c*), thereby controlling the rate at which secondary die 22 allows the initial extrusion 62 to flow through the primary die opening 16. Stick-slip extrusion will be eliminated during the second stage extrusion of primary extrusion product 62 through die opening 30 by the inherent stability caused by the fluid pressure in chamber 14 and the fluid pressure above die opening 30 in the chamber defined by primary extrusion 62, chamber 20, and die surface 20, being slightly higher than that required for the unrestricted hydrostatic extrusion of primary extrusion 62 through die opening 10, such that the primary billet 60 is held stationary against die opening 16. It is possible to achieve extrusion through primary die opening 16 against a desired die pressure by providing a restraining action against primary extrusion 62 with the secondary die 22 by maintaining pressure in the fluid below piston section 26 and simultaneously controlling the pressure of the fluid above die opening 30 with an external pressure system (not shown).

Figure 2:
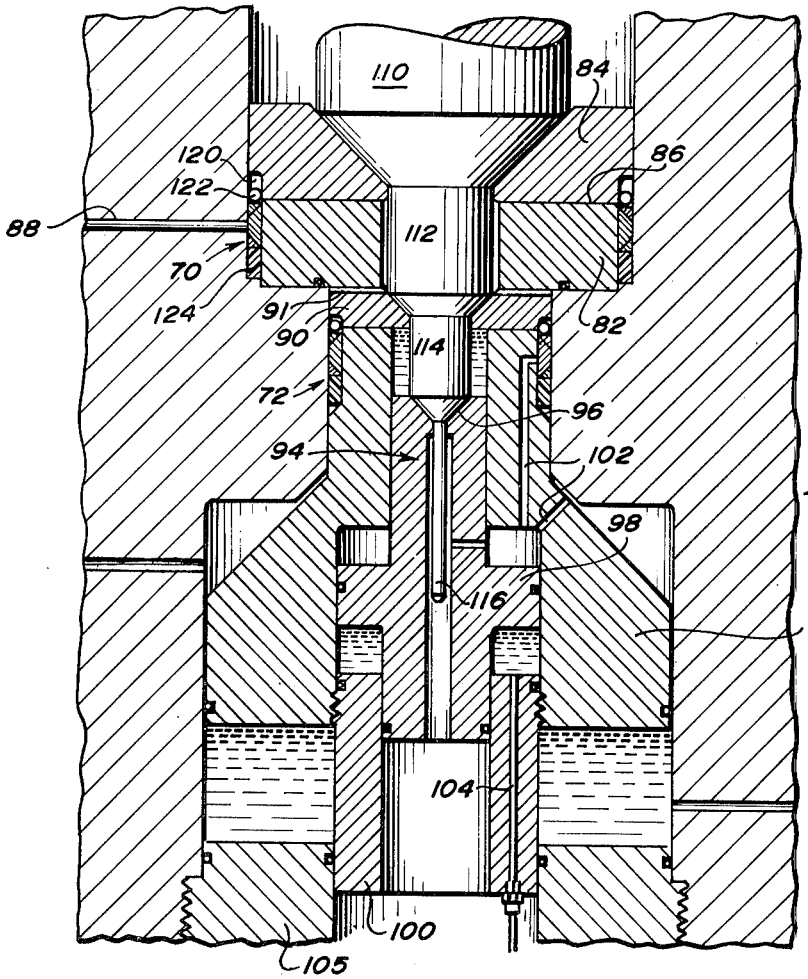
FIG. 2 is a fragmentary view partially in cross-section of a three-stage hydrostatic extrusion die assembly according to the present invention.
Figure 3A:
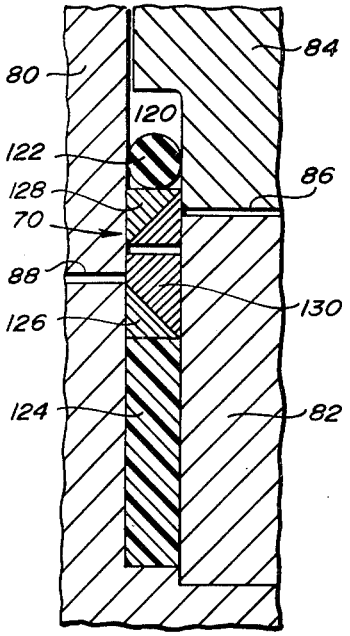
FIGS. 3*a*, 3*b*, and 3*c* are fragmentary cross-sectional views illustrating the pressure balancing die seal assembly of the apparatus of FIG. 2.
Figure 3B:
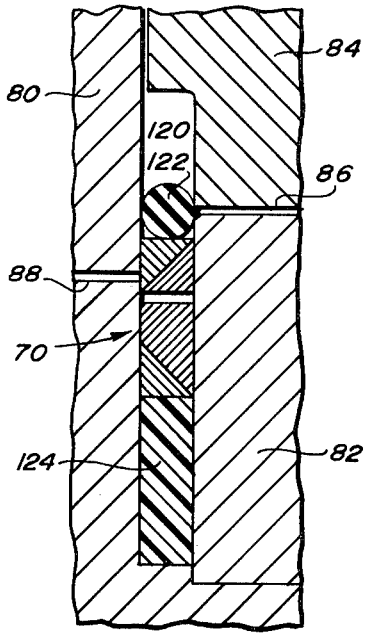
Figure 3C:
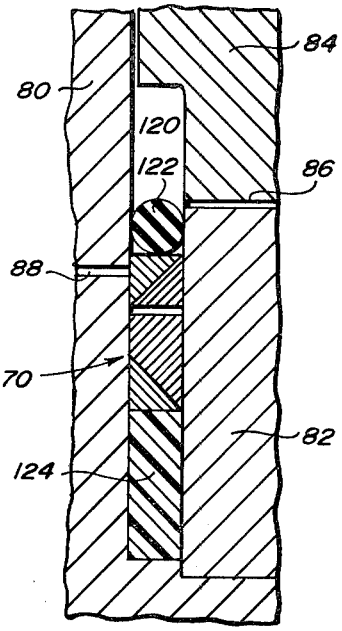

In FIG. 2, there is illustrated a three-stage apparatus of the present invention. FIG. 2 serves to illustrate that the number of successive extrusions can be large, being limited only by the size of the apparatus and the material being extruded. The operation of the device of FIG. 2 is similar to that described in connection with FIG. 1, except that pressure equalizing die seals are employed to replace the external conduits and valves used for fluid transfer in the apparatus of FIG. 1. The die seals are shown generally as 70 and 72 of FIG. 2 and they are shown in more complete detail in FIGS. 3*a*, 3*b*, and 3*c*. Only one of the seals is illustrated in FIGS. 3*a*, 3*b*, and 3*c*; the other, acting in an identical manner. Referring now to FIG. 2, the apparatus includes a cylinder 80 having contained therein a two-piece primary die having a lower portion 82 and an upper portion 84 with a micro port therebetween, the port being illustrated by line 86. The upper die 82–84 is sealed within cylinder 80 by pressure equalizing die seal 70. Pressure equalizing die seal 70 communicates with a conduit 88, the purpose of which will be explained more fully hereinafter. Disposed below primary die 82, 84 is a secondary die 90 having associated with it a secondary pressure chamber, the secondary pressure chamber 91 being defined by the bottom of 82, the upper surface of secondary die 90 and the inner wall of cylinder 80, secondary die 90 and tertiary pressure chamber assembly 92 being sealed to the cylinder 80 by pressure equalizing die seal 72. Slidably mounted within tertiary pressure chamber 92 is a tertiary die 94 having a die opening 96 and piston section 98. The cylinder is closed by end closure 105. Tertiary pressure chamber 92 has associated vent conduits 102. Conduit 104 is included through enclosure 100 to enable fluid to be forced against piston section 98 of tertiary die 96. The extrusion process for extruding a billet 110 proceeds as described in relation to FIGS. 1*a*, 1*b*,and 1*c*, except that there are now primary extrusion 112, secondary extrusion 114, and the tertiary or final extrusion 116, all accomplished in sequential fashion as described in relation to FIG. 1.

Referring to FIG. 3, and in particular FIG. 3*a*, pressure equalizing die seal 70 is illustrated prior to pressurization of fluid contained in the chamber defined by primary die 82, 84 and cylinder 80 and pressure equalizing die seal 70; this chamber being referred to as 120.

The pressure equalizing die seal comprises in combination an O-ring 122, a compressible elastomer column 124, miter rings 126, 128, and vent ring 130. As fluid pressure in chamber 120 is increased to effect the primary extrusion, O-ring 122 retains the fluid pressure in chamber 120, although the elastomer column 124 is compressed (FIG. 3*b*). As shown in FIG. 3*c*, as the pressure in chamber 120 increases with the termination of the primary extrusion caused by secondary pressure chamber 92 contacting end closure 105, the elastomer column 124 is compressed further so that O-ring 122 moves past micro port 86 and fluid contained in chamber 120 passes through micro port 86 into the cavity defined by the primary extrusion 122, adjacent die section 82, secondary extrusion die 90, and secondary extrusion chamber 91. Vent 88 is included to prevent fluid pressure from building up in the elastomer column cavity and thus negatively influencing the operation of the pressure equalizing seal. Vent ring 130 is included to aid in minimizing pressure buildup on the elastomer column cavity. Miter rings 126, 138, in cooperation with the design of the vent ring 130, insure that the elastomer column 124 and O-ring 122 do not extrude in the low pressure zone of cavity 120.

Referring back to FIGS. 2 and 3, the apparatus operates as follows. As the billet 110 is extruded through primary extrusion die 82, the secondary extrusion die 90 begins to move together with tertiary pressure chamber assembly 92 until the secondary die 90 and tertiary pressure chamber 92 travel the full stroke. After this has taken place, fluid pressure in fluid chamber 120 is increased a small amount (approximately 5% to activate the primary die pressure equalizing seal 70 and allow fluid to flow from chamber 120 through micro port 86 into the cavity between primary extrusion 112 and primary die section 82 then between secondary die 90 and secondary pressure chamber 91. Hydraulic pressure is then applied to the piston supporting secondary die 90 causing secondary die 90 to move against primary extrusion 112 and extruded this section 112 through the secondary die 90 to form secondary extrusion 114. Excess fluid in the cavity between primary extrusion 112 an secondary pressure chamber 91 will flow back through micro port 86 into chamber 120.

After the secondary die has gone its full stroke, the pressure in chamber 120 and surrounding primary extrusion 112 is raised again approximately 5% to activate the secondary die pressure equalizing seal 72 and allow fluid to flow into the cavity surrounding secondary extrusion 114. When the pressure surrounding secondary extrusion 114 is in equilibrium with the remainder of the high pressure fluid system, the low pressure hydraulic system is pressurized through conduit 104 and tertiary extrusion die 94 begins to form tertiary extruded section 116. Upon completion of the tertiary extrusion 116, the primary chamber fluid pressure is reduced to deactivate the pressure equalizing seals, then the secondary and tertiary low pressure hydraulic pressures are reduced to zero gauge pressure. At this point, primary extrusion will again commence and initiate the next extrusion cycle. Extrusion cycles are continued until the desired amount of the original billet 110 is extruded to the final shape 116.

Figure 4:
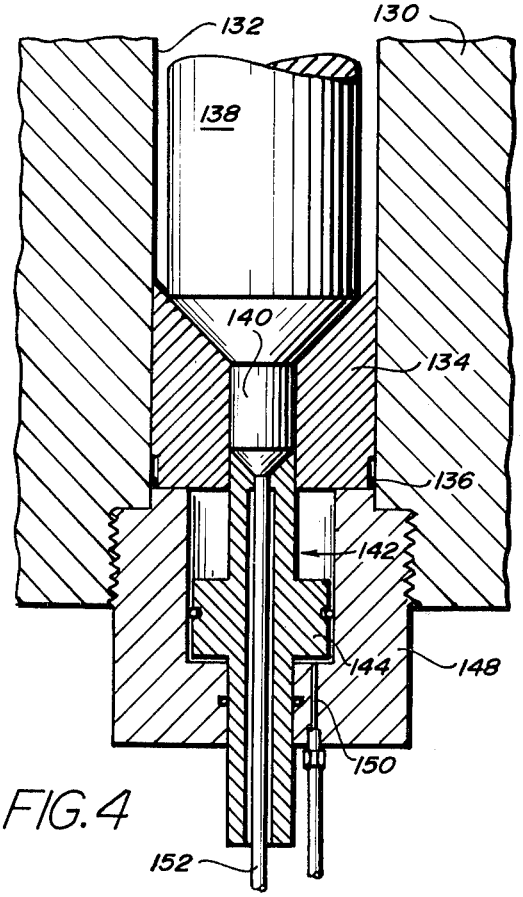
FIG. 4 is a fragmentary view partially in section of a combined hydrostatic and conventional extrusion process according to the present invention.

FIG. 4 shows a conventional cold extrusion die as the second stage in conjunction with a primary hydrostatic extrusion die according to the present invention. The modification illustrated in FIG. 4 simplifies the overall apparatus and its operation; however, there is an attendant sacrifice in the lubrication advantage of hydrostatic extrusion, thus making it necessary to apply a suitable lubricant to the billet; the composition and quantity of the lubricant being determined by the billet material and the operational extrusion fluid as is well known in the art. As before, there is a primary cylinder 130 defining a primary extrusion or pressure chamber 132. Cylinder 130 is closed at one end by a first die 134, generally referred to a the primary die. The die 134 is sealed to the cylinder 130 by conventional sealing means such as O-ring 136. Chamber 132 is designed to withstand operational fluid pressures so that billet 138 can be extruded through primary die 134 to provide a first extrusion section 140. The operational fluid contained in chamber 132 can be pressurized directly by a ram disposed in the chamber 132 or by sealing the chamber and using a suitable external pump. Billet 138 is extruded at an appropriate rate to provide the primary extrusion 140 which moves secondary die 142 until the piston portion 142 of die 142 reaches the end of its stroke as determined by closure 148, disposed in the end of cylinder 130. The pressure in the fluid-contained chamber 132 is then increased by approximately 5% or more as required to insure that the billet 138 remains in contact with primary die 134 during the secondary extrusion. After the pressure is increased, hydraulic fluid is forced through conduit 150 acting on piston section 144 of die 142 starting secondary extrusion through die 142 producing a product extrusion 152. Secondary extrusion continues until the secondary die 142 travels its full stroke as determined by piston section 144 contacting the bottom of die 134. At this point, hydraulic pressure below piston section 144 of die 142 is reduced to zero or a suitable pressure required for a back pressure extrusion and billet 138 is again forced through primary die 132 by the fluid contained in chamber 132, thus initiating the next step. As before, the cycle continues until the desired amount of billet 138 is extruded to final size and shape.

Figure 5:
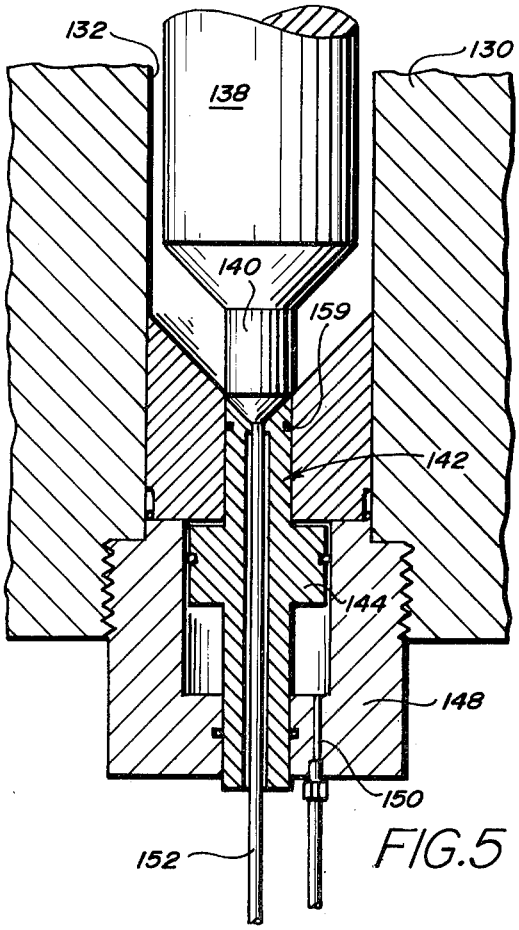
FIG. 5 is a fragmentary view partially in section of the apparatus of FIG. 4 converted to a first and second stage hydrostatic extrusion apparatus.

There is shown in FIG. 5 a modification of the apparatus of FIG. 4 wherein the second stage of the device of FIG. 4 is converted to a second stage hydrostatic extrusion by addition of O-ring seal 159 on secondary die 142. The apparatus of FIG. 5 functions in a similar manner as the apparatus of FIG. 4 until the primary extrusion 10 is completed. At this point, the fluid pressure in chamber 132 is lowered so that, when hydraulic fluid is forced against piston 144 of secondary die 142, the secondary extrusion of primary extrusion 140 through die 142 does not occur. Instead, secondary die 142 moves the product 140 to the position shown in FIG. 5 so that the complete length of primary extrusion 140 is exposed to the fluid pressure contained in chamber 132.

With the hydraulic pressure on piston section 144, sufficient to hold die 142 in place, the pressure of fluid in chamber 132 is raised to cause the primary extrusion product 140 to hydrostatically extrude through die 142. When the billet 138 comes in contact with primary die 134 and extrusion through secondary die 142 stops, the hydraulic pressure on piston 144 is relieved and extrusion of billet 138 through primary die 134 begins, thus starting another extrusion cycle.

An apparatus according to FIG. 4 was constructed and used to extrude an aluminum alloy of the 1100 -0 type. A billet 11.0 millimeters in diameter was hydrostatically extruded through the primary die having a die opening of 3.40 millimeters at a fluid pressure of 63.0 kg/mm$^2$. The primary extrusion measured 11.4 millimeters in length and was then conventionally extruded to 1.0 millimeters in diameter, 78 millimeters long, by the secondary die at 98.0 kg/mm$^2$ extrusion pressure. The cycles were successfully repeated to take an overall billet to final product reduction with 99.2% reduction in area of the original billet.

With an apparatus and method according to the invention, it is possible to either use hot or cold extrusion techniques in conjunction with the present invention. The temperature at which the billet is extruded will depend on the material itself together with the reduction desired.

Figure 6:
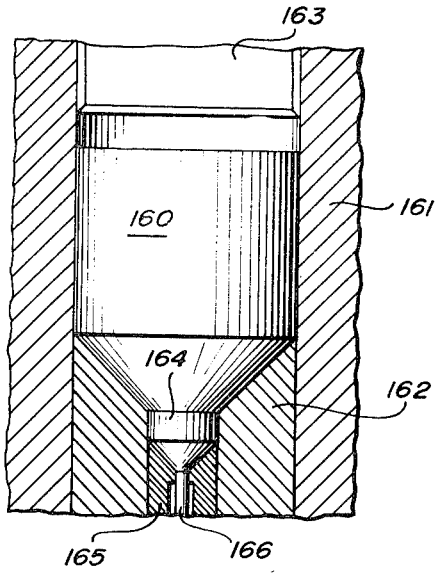
FIG. 6 is a fragmentary view partially in section of a conventional first-stage extrusion die in combination wtih a conventional second-stage extrusion die employing the method of the instant invention.

FIG. 6 illustrates the application of the method of the present invention to an apparatus using entirely conventional extrusion which may be carried out at ambient or elevated temperature. Billet 160 is placed into a conventional, cylindrical extrusion chamber 161 and forced through primary die 162 by ram 163. In a manner of operation similar to that presented for hydrostatic extrusion, the desired portion of billet 160 is extruded into primary extrusion product 164 which is in turn extruded through secondary extrusion die 165 to produce secondary extrusion product 166. The secondary extrusion is produced by forcing the secondary die 165 against the primary extrusion product 164 while holding billet 160 stationary with pressure from ram 163. Thus, conventional two-stage extrusion dies can be used to practice the method of the instant invention.

It would also be possible to apply the method of the present invention to extruding long filamentary products, e.g. wire products. In the extrusion of wire products, it may be necessary to provide an intermediate looping chamber to accumulate the previously extruded material prior to the next stage. Such gathering and looping in hydrostatic extrusion of continuous wire is illustrated in FIG. 7 of the drawing.

Figure 7:
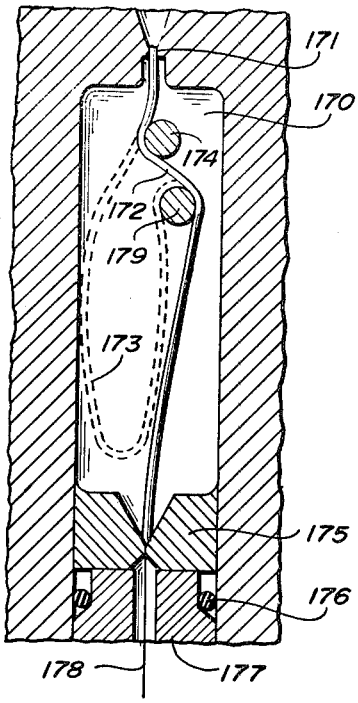
FIG. 7 is a fragmentary view partially in section illustrating a method and apparatus for extruding elongated filamentary material according to the present invention.

In the method and apparatus of FIG. 7, extruded filament 172 from a prior extrusion stage having die outlet 171 enters into a fluid-filled cylindrical chamber 170 and forms filament loop 173, shown in dotted lines, with the aid of guide pins 174 and 179. Then, die 175 is forced into chamber 170 causing the fluid therein to be pressurized to a pressure which hydrostatically extrudes filament 172 through die 175, yielding a long, filamentlike extrusion product 178. The die 175 is forced into chamber 170 by the action of die ram 177 which is made fluidtight with the help of O-ring 176. The extrusion of filament 172 continues until it is stretched taut across guide pins 174 and 179 (as shown) thereby eliminating loop 173. Simultaneously, fluid pressure in chamber 170 rises above the pressure required to extrude the filament 172 through die 175 causing a slight tension in filament 172. This pressure rise signals the end of this extrusion cycle and the die ram 177 force on die 175 is reduced to zero. The die 175 moves to allow the volume of extrusion chamber 170 to increase and to allow the fluid in chamber 170 to be depressurized. Next, a new filament loop 173 is extruded into chamber 170 to initiate the next cycle.

Figure 8:
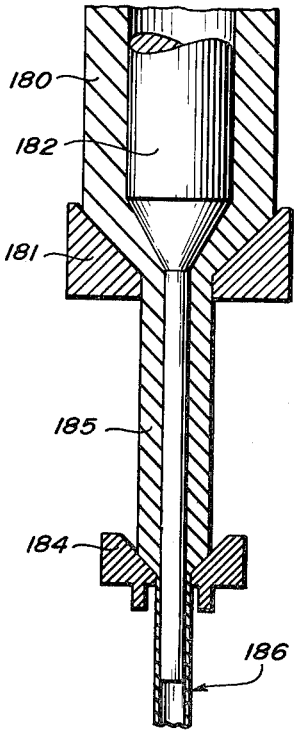
FIG. 8 is a fragmentary view partially in section illustrating a method and apparatus for extruding tubular products according to the present invention wherein the inside diameter of the extrusion is constant in each stage.
Figure 9:
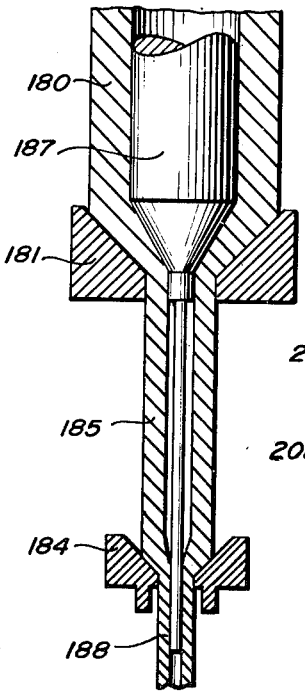
FIG. 9 is a fragmentary view partially in section illustrating a method and apparatus for extruding tubular products according to the present invention wherein the inside diameter of the extrusion is reduced between stages.
Figure 10:
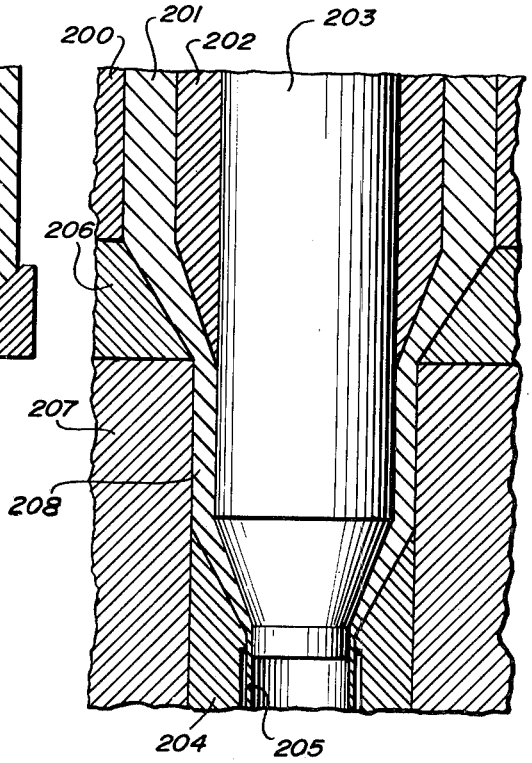
FIG. 10 is a fragmentary view partially in section illustrating a method and apparatus for extruding tubular products wherein a multi-component mandrel is used.

This invention also applies to the extrusion of products having a hollow cross-section including, inter alia, tubular shapes. Mandrels for controlling the interior dimensions of the hollow products are shown in FIGS. 8, 9, and 10. FIG. 8 illustrates a mandrel 182 which remains stationary with respect to the primary die 181. Hollow billet 180 is hydrostatically extruded through die 181 with mandrel 182 controlling the inside dimensions of the primary extrusion product 185. The mandrel 182 is fixed in the apparatus so that it remains stationary with respect to die 181. Mandrel 182 consists of a cylindrical portion fitting inside hollow billet 180; this cylindrical portion of mandrel 182 terminates at an integral, conical section located inside the deformation zone of die 181. Extending axially from the small end of the conical section is an integral, cylindrical section which extends past the exit of the secondary extrusion die 184. This cylindrical section controls the inside dimensions of the secondary extrusion product 186 as it exits from secondary extrusion die 184.

FIG. 9 shows an extrusion arrangement identical to that of FIG. 8 except that stationary mandrel 187 has been modified. Mandrel 187 consists of a cylindrical section fitting inside the hollow billet 180 which terminates in an integral, conical section as before. However, the cylindrical section extending from the small end of the conical section extends only slightly beyond the primary die 181 outlet before it is reduced in diameter. The reduced diameter section of the mandrel extends through the hollow primary extrusion product 185 and through the secondary extrusion die 184. The reduced diameter of the extension of mandrel 187 results in a reduced inside diameter of secondary extrusion product 188 as it exits from secondary extrusion 184.

FIG. 10 show a two-component mandrel arrangement for a two-stage extrusion of a tubing cross-section using this invention. In this example, the basic process is conventional extrusion. Hollow billet 201 is accepted into the primary extrusion chamber 200 and forced through primary die 206 by a hollow ram not shown. Controlling the inside dimensions of the primary deformation zone of billet 201 as it flows through primary die 206 is the hollow, cylindrical primary mandrel 202, which remains stationary with respect to die 206. The solid cylindrical section of the secondary mandrel 203 slides inside of the primary extrusion mandrel 202 and controls the inside diameter of the primary extrusion product 208 as it exits from the primary die 206 and during the secondary extrusion process of primary extrusion product 208 through secondary die 204. The secondary mandrel 203 is mechanically or hydraulically constrained to move in cooperation with the secondary die 204 always maintaining the same relative position with respect to secondary die 204. The conical section of secondary mandrel 203 and the short cylinder extending from the small end of the conical section controls the inside dimensions of the primary extrusion product as it flows through die 204 and exits as the secondary extrusion product 205.

It is obvious that the die assembly and the method of the present invention can be embodied in various forms and movement of one die relative to the other can be accomplished in numerous ways and in varying sequences without departing for the spirit and scope of the present invention.

Of course, the invention is not limited in any respect to materials of construction, the materials of construction being selected on the basis of the material being extruded.

In all embodiments of the invention, the pistons, cylinders, dies, die holders, rams and the like can be manufactured in multiple parts as is known in the art. While the invention is illustrated with the dies vertically oriented, the orientation of the dies is not critical and they may be operated in a horizontal, vertical, or acute angular position.

Having thus described my invention, what I desire to have secured by Letters Patent of the United States is set forth in the following claims. I claim:

1. A method for hydrostatic extrusion of a billet including the steps of:

extruding a portion of the billet through a first die ths forming a primary extrusion section of the billet;

stopping said primary extrusion followed by extruding the primary extrusion section through a secondary die, thus forming a secondary extrusion defining said desired size and shape of the finished extrusion;

stopping said secondary extrusion while simultaneously initiating extrusion of the billet to form a second primary extrustion section; and alternately extruding said billet and said primary extrusion sections until said billet is extruded to the desired corss-section dize, shape, and length.

2. A method according to claim 1 wherein said secondary extrusion is subjected to an extrusion, thus forming a tertiary extrusion, before said billet is subjected to further extrusion steps.

3. A method according to claim 1 wherein a plurality of incremental, ever decreasing in size extrusions are formed in a step-wise manner alternately until said billet is extruded to the desired size and shape.

4. A method according to claim 1 wherein a hollow billet is extruded over a solid mandrel.

5. A method according to claim 1 wherein said primary extrusion is an elongated filament which is accumulated in a pressure chamber which is pressurized after completion of the primary extrusion to force the primary extrusion through the secondary die.

6. A method of extruding a billet including the steps of:

hydrostatically extruding a portion of the billet through a first die thus forming a primary extrusion section of the billet;

stopping said primary extrusion followed by extruding the primary extrusion section through a secondary die by conventional extrusion means, thus forming a secondary extrusion defining the desired size and shape of the finished extrusion;

stopping said secondary extrusion while simultaneously initiating extrusion of the billet to form a secondary primary extrusion section; and alternately extruding said billet and said primary extrusion sections until said billet is extruded to the desired cross-section size, shape, and length.

7. A method according to claim 6 wherein said billet is further extruded by extruding said secondary extrusion by conventional means to form a tertiary extrusion to a desired smaller cross-section size, shape, and length.

8. A method according to claim 6 wherein said billet is further extruded by conventional means to form a tertiary extrusion section and said tertiary extrusion section is extruded by hydrostatic means to form a quarternary extrusion section.

9. A method of extruding a billet including the steps of:

extruding a portion of the billet through a first die by conventional means thus forming a primary extrusion section of the billet;

stopping said primary extrusion followed by hydrostatically extruding the primary extrusion section through a secondary die, thus forming a secondary extrusion defining the desired size and shape of the finished extrusion;

stopping said secondary extrusion while simultaneously initiating extrusion of the billet to form a secondary primary extrusion section; and alternately extruding said billet and said primary extrusion sections until said billet is extruded to the desired cross-section size, shape, and length.

10. A method of extruding a billet including the steps of:

hydrostatically extruding a portion of the billet through a first die thus forming a primary extrusion section of the billet;

stopping said primary extrusion followed by hydrostatically extruding the primary extrusion section through a secondary die thus forming a secondary extrusion defining the desired size and shape of the finished extrusion;

stopping said secondary extrusion while simultaneously initiating extrusion of the billet to form a secondary primary extrusion section; and alternately extruding said billet and said primary extrusion sections until said billet is extruded to the desired cross-section size, shape, and length.

11. A method according to claim 10 wherein said secondary extrusion is hydrostatically extruded, thus forming a tertiary extrusion before said billet is subjected to further extrusion steps.

12. A method according to claim 10 wherein a plurality of incremental, ever decreasing in size extrusions are formed in a step-wise manner alternately until said billet is extruded to the desired size and shape.

* * * * *